US008616404B1

(12) United States Patent
Starck et al.

(10) Patent No.: US 8,616,404 B1
(45) Date of Patent: Dec. 31, 2013

(54) SHIPPING CONTAINER

(75) Inventors: Robert Starck, Grand Rapids, MI (US); Lou Wordelman, Grand Rapids, MI (US); Paul S. Blanton, Aiken, SC (US); Kurt R. Eberl, Aiken, SC (US)

(73) Assignees: Savannah River Nuclear Solutions, LLC, Aiken, SC (US); Paragon D&E, Grand Rapids, MI (US)

( * ) Notice: Subject to any disclaimer, the term of this patent is extended or adjusted under 35 U.S.C. 154(b) by 125 days.

(21) Appl. No.: 13/151,733

(22) Filed: Jun. 2, 2011

Related U.S. Application Data

(60) Provisional application No. 61/351,150, filed on Jun. 3, 2010.

(51) Int. Cl.
*B65D 83/72* (2006.01)
*B65D 45/00* (2006.01)
*B65D 45/32* (2006.01)

(52) U.S. Cl.
USPC ..... 220/592.25; 220/592.2; 220/315; 220/320

(58) Field of Classification Search
USPC ..... 215/273–275; 220/4.12, 4.04, 560.15, 220/592.2, 592.25; 250/506.1; 376/272; 588/16, 249
See application file for complete search history.

(56) References Cited

U.S. PATENT DOCUMENTS

| | | | | | |
|---|---|---|---|---|---|
| 3,466,662 | A * | 9/1969 | Blum | 250/506.1 |
| 3,669,299 | A * | 6/1972 | Jones et al. | 220/592.2 |
| 3,845,315 | A * | 10/1974 | Blum | 250/506.1 |
| 5,646,971 | A * | 7/1997 | Howe | 376/272 |
| 6,299,950 | B1 * | 10/2001 | Byington et al. | 428/34.5 |
| 6,489,623 | B1 * | 12/2002 | Peters et al. | 250/506.1 |
| 2004/0042849 | A1 * | 3/2004 | Jurich et al. | 404/25 |
| 2008/0073601 | A1 * | 3/2008 | Temus et al. | 250/507.1 |

* cited by examiner

*Primary Examiner* — J. Gregory Pickett
*Assistant Examiner* — Kaushikkumar Desai
(74) *Attorney, Agent, or Firm* — McBarry Bair PC

(57) ABSTRACT

A shipping container for enclosing a material container containing nuclear and/or other hazardous material. The shipping container can include a body having an open top and a lid assembly for closing the open top. The body can include a liner arranged in spaced relationship with the body to define a space therebetween. The lid assembly and the body can together define a storage chamber in which the material container is housed. The lid assembly can have a lid top and a lid liner coupled to the lid top to define a space therebetween. The space in the lid assembly can also include one or more reinforcing members to increase the compression strength of the lid assembly. The spaces in the body and lid assembly can be filled with a liner material, such as foam, to increase stiffness.

18 Claims, 11 Drawing Sheets

SHIPPING CONTAINER

CROSS-REFERENCE TO RELATED APPLICATION

This application claims the benefit of U.S. Provisional Patent Application No. 61/351,150, filed Jun. 3, 2010, which is incorporated herein by reference in its entirety.

BACKGROUND OF THE INVENTION

Containers for shipping nuclear, radioactive, and/or other hazardous material can have a dual structure, whereby an inner container storing the hazardous material is encapsulated within an outer container to protect the inner container. In one type of shipping container assembly, a 30-gallon drum-type vessel can be encased within a 55-gallon drum-type vessel. Both vessels can include a barrel-like body closed by a lid. The 55-gallon drum-type vessel can include a filling or insulation, such as cardboard or fiberboard, around the 30-gallon drum-type vessel.

BRIEF DESCRIPTION OF THE INVENTION

According to one aspect of the invention, a shipping container for enclosing a material container containing a hazardous material comprises a body having an open top, a liner disposed within the body in a spaced relationship to an interior surface of the body, the inner liner defining a space between an outer surface of the liner and the interior surface of the body, a foam material disposed in the space between the body and the liner, and a lid assembly for closing the open top, whereby, when the lid assembly is mounted over the open top of the body, a storage chamber is defined within the body by the liner and an interior surface of the lid assembly.

According to another aspect of the invention, a shipping container for enclosing a material container containing nuclear and/or other hazardous material comprises a body having an open top and a lid assembly for closing the open top. The lid assembly comprises a lid top, a lid liner coupled to the lid top to define a lid space therebetween, a liner material disposed in the lid space between the lid top and the lid liner to increase the stiffness of the lid assembly, and a plurality of reinforcing members disposed within the lid space to increase the strength of the lid top with respect to the lid liner, whereby, when the lid assembly is mounted over the open top of the body, a storage chamber is defined within the body by the liner and an interior surface of the lid assembly.

DESCRIPTION OF EMBODIMENTS OF THE INVENTION

The present invention relates generally to a shipping container assembly for nuclear, radioactive, and/or other hazardous material. In one of its aspects, the invention relates to a shipping container with an improved lid assembly. It is to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
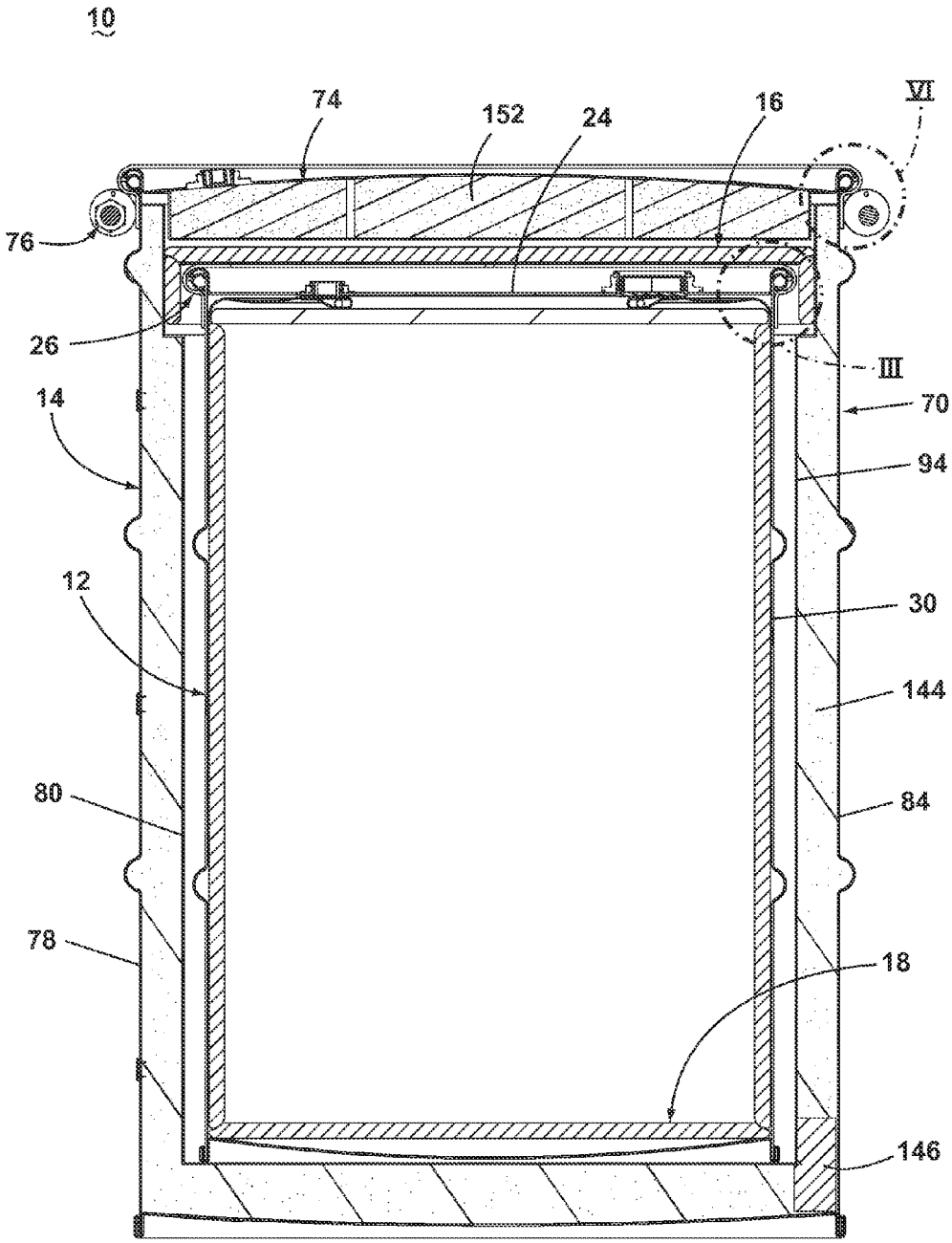
FIG. 1 is a cross-sectional view through a shipping container assembly in accordance with one embodiment of the present invention, the shipping container assembly including a material container enclosed within a shipping container.

FIG. 1 is a cross-sectional view through a shipping container assembly 10 in accordance with one embodiment of the present invention. The shipping container assembly 10 comprises an inner material container 12 and an outer shipping container 14 which can encapsulate the inner material container 12. The inner material container can contain nuclear and/or other hazardous material, such as nuclear waste. In one embodiment, the inner material container 12 can comprise a 30-gallon drum-type vessel and the outer shipping container 14 can comprise a 55-gallon drum-type vessel, and/or the shipping container assembly 10 can be rated to permit the shipment of Type-AF quantities of radioactive material. Specifically, in one embodiment, the shipping container assembly 10 can be designed to ship materials in accordance with U.S. Department and Transportation ("DOT") 49 C.F.R. requirements and Nuclear Regulatory Commission ("NRC") 10 C.F.R. requirements, including 10 C.F.R. 71 and 10 C.F.R. 73.

Optionally, an insulation cover 16 and an insulation bag 18 can be provided, which fit around the top of the material container 12 and inside the material container 12, respectively. The insulation cover and bag 16, 18 can be at least partially fabricated from an insulating material, such as wool or a wool-blend, sandwiched between layers of a fabric cloth. The insulation cover 16 and/or insulation bag 18 can be used with the shipping container assembly 10 when transporting combustible material to keep the material below its combustion temperature.

Figure 2:
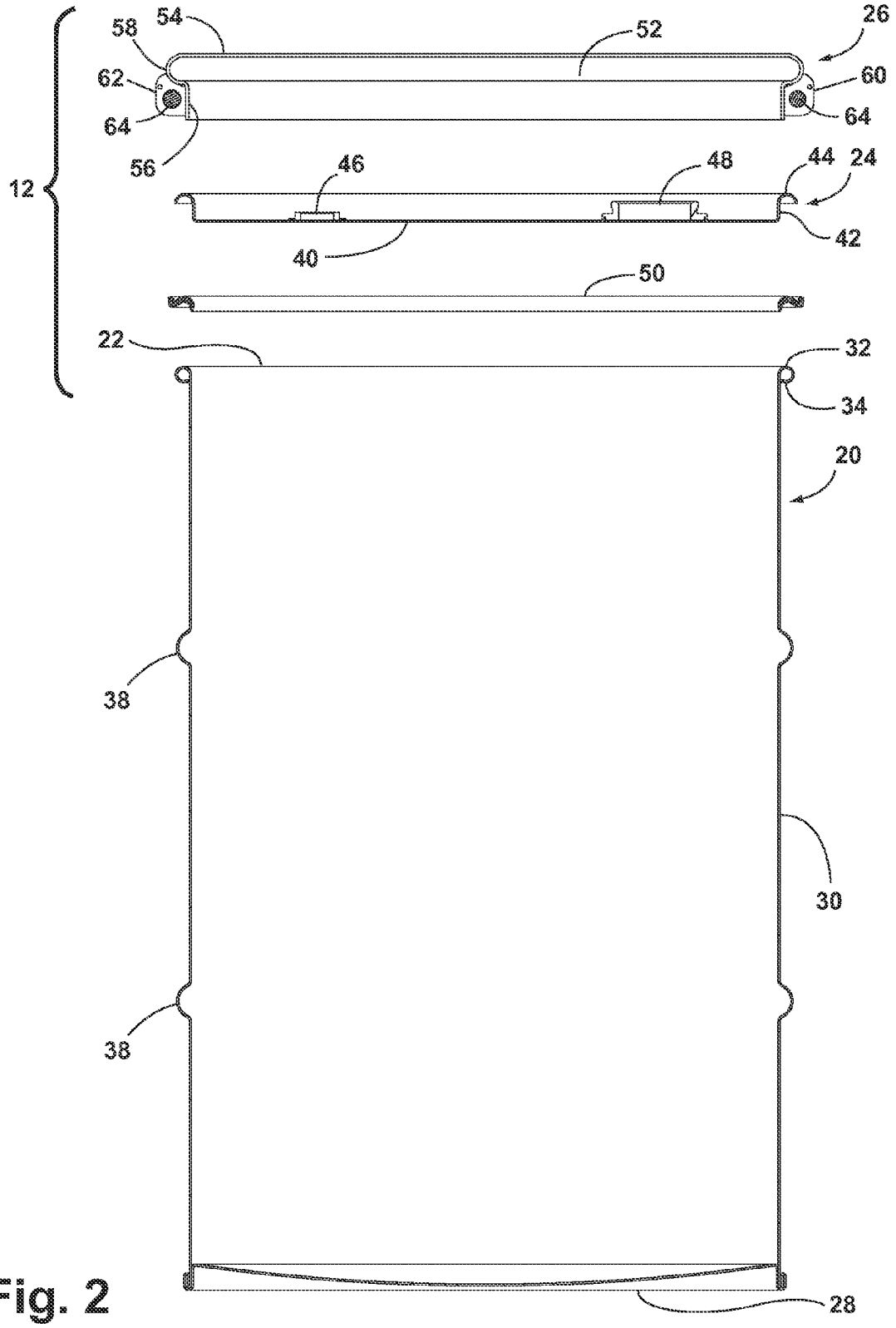
FIG. 2 is an exploded, cross-sectional view of the material container from FIG. 1.

FIG. 2 is an exploded, cross-sectional view of the material container 12 from FIG. 1, which can comprise a body 20 having an open top 22, a lid 24 for closing the open top 22, and a split ring assembly 26 for securing the lid 24 to the body 20. The material container lid 24 can be sized and configured to define a closed interior when seated on the body 20. The body and lid 24 can be manufactured from carbon steel.

The body 20 as illustrated is generally cylindrical and comprises a bottom wall 28 and a peripheral side wall 30 extending upwardly from the bottom wall 28 to an upper edge 32 defining the open top 22 of the body 20. The upper edge 32 can comprise an annular beaded rim 34. The peripheral side wall 30 can include one or more reinforcing ribs 38. As illustrated, two vertically-spaced, circumferential ribs 38 are formed in the peripheral side wall 30.

The lid 24 can comprise a circular plate assembly 40 with a peripheral side wall 42 extending upwardly from the plate assembly 40 and having an annular curved flange 44 at the upper end of the side wall 42. One or more bung hole features 46, 48 can be provided in the plate assembly 40 and can allow assembly of standard bung closure fittings. The bung hole features 46, 48 may not extend below the bottom surface of the plate assembly 40 and may be attached to the plate assembly 40 with gaskets (not shown). A gasket 50 can be positioned between the curved flange 44 of the lid 24 and the upper edge 32 of the body 20. The gasket 50 can be formed of a fire-retardant material, such as ultra-high temperature silicone.

Figure 3:
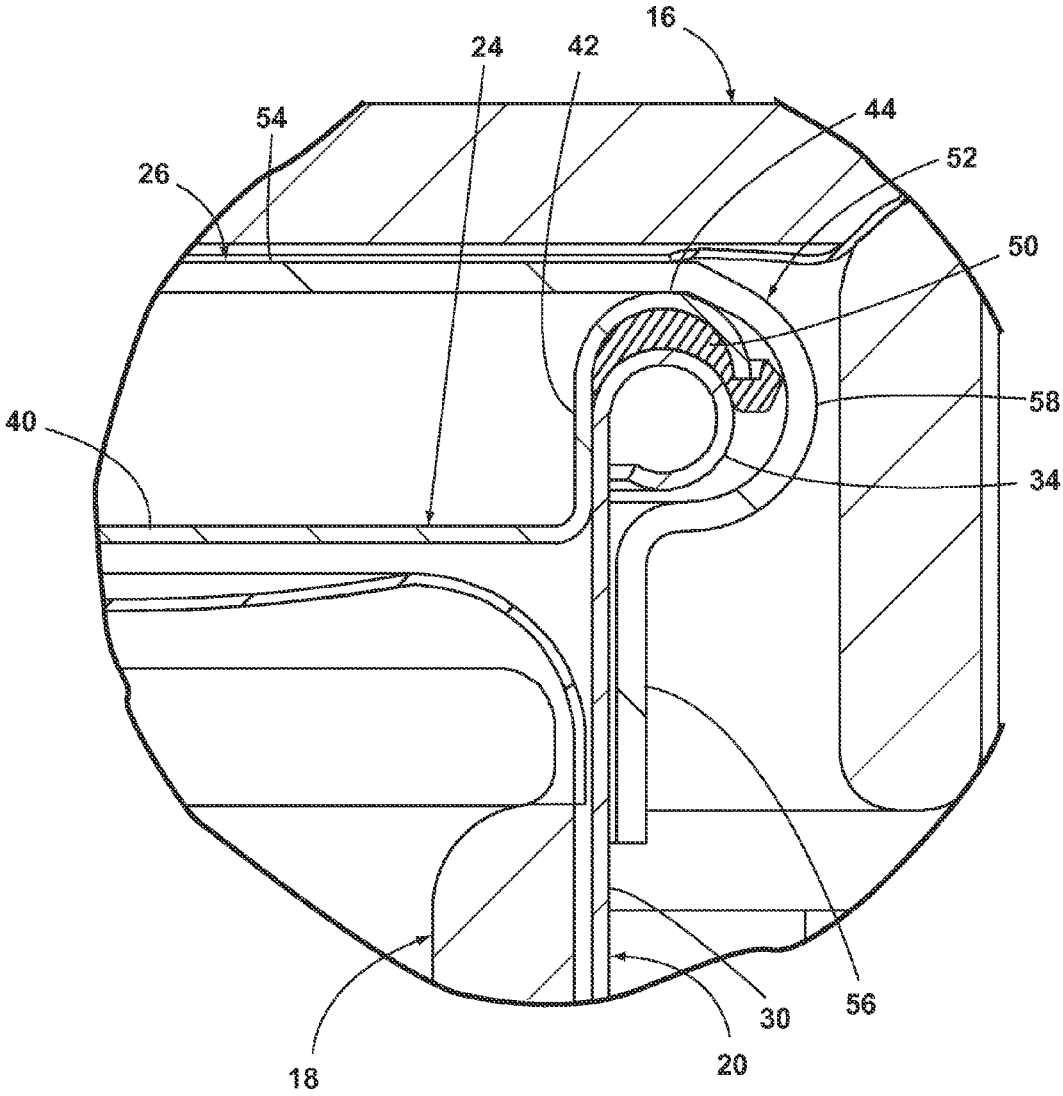
FIG. 3 is a close-up view of section III of FIG. 1.

Referring additionally to FIG. 3, which is a close-up view of section III of FIG. 1, the split ring assembly 26 can comprise a pair of hemispherical retaining rings 52, each having an annular top wall 54 joined to a side wall 56 by a curved portion 58 and terminating at one end in a threaded lug 60 and at the other end in an unthreaded lug 62. The retaining rings 52 are applied about assembled body 20 and lid 24, with the curved portion 58 receiving the beaded rim 34 of the body 20 and the curved flange 44 of the lid 24, the side wall 56 flush or nearly flush against the side wall 30 of the body 20, and the top wall 54 overlying the lid 24. In this position, the threaded lug 60 on one ring 52 is matched with the unthreaded lug 62 on the other ring 52. At least one fastener 64 secures the each pair of lugs 60, 62 together.

Figure 4:
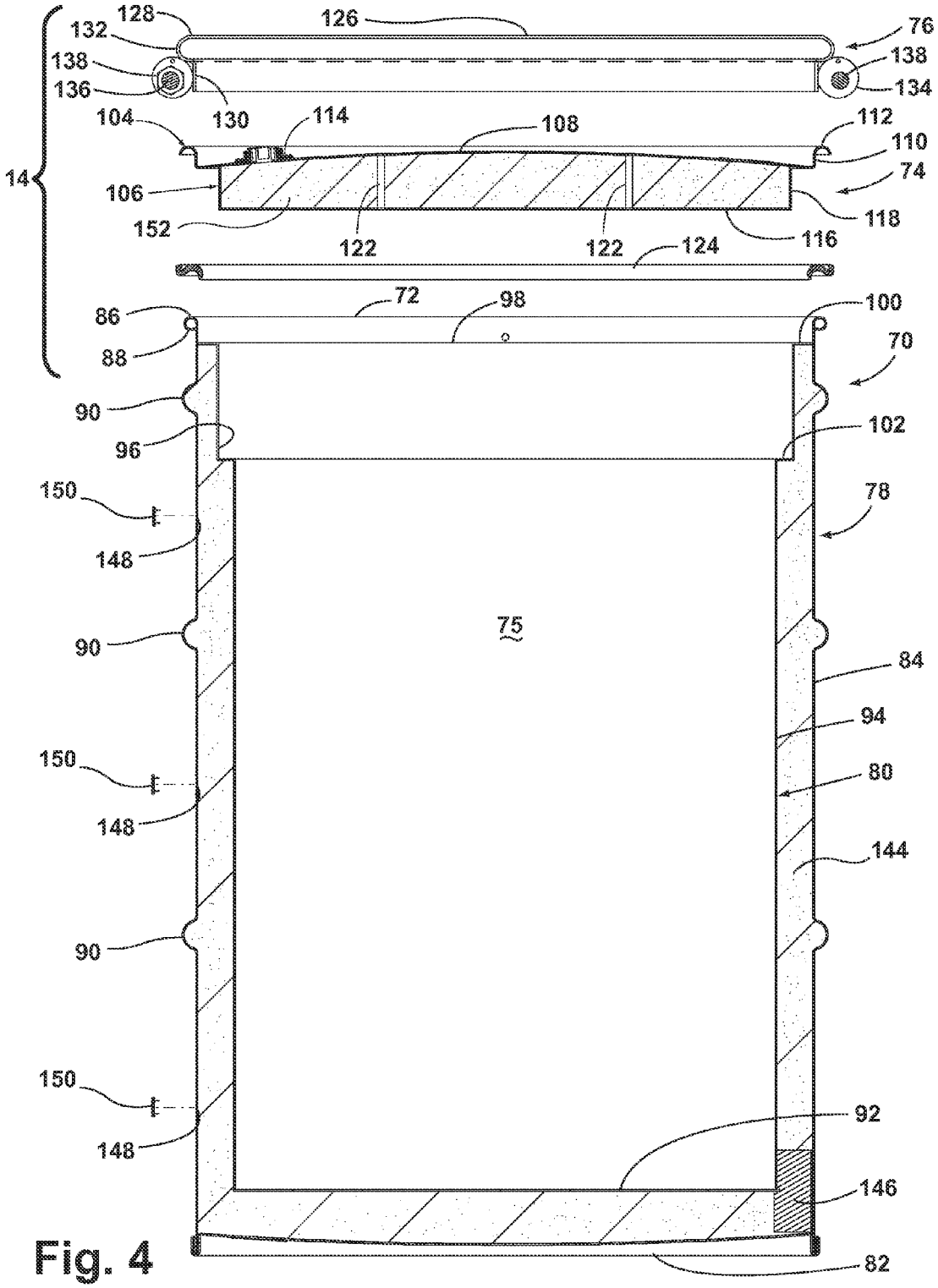
FIG. 4 is an exploded, cross-sectional view of the shipping container from FIG. 1, the shipping container having a body, a lid assembly, and a split ring assembly.

FIG. 4 is an exploded, cross-sectional view of the shipping container 14 from FIG. 1, which can comprise a body 70 having an open top 72, a lid assembly 74 for closing the open top 72, and a split ring assembly 76 for securing the lid assembly 74 to the body 70. The lid assembly 74 can be sized and configured to define a closed interior or storage chamber 75 when seated on the body 70. The shipping container body 70 can comprise an outer body member 78 and an inner body member 80 received within the outer body member 78. As such, the inner body member 80 can form a liner for the shipping container 14. The outer and inner body members 78, 80 can be manufactured from carbon steel. The inner body member 80 can be joined with the outer body member 78 in any suitable manner. In one embodiment, the inner body member 80 can be welded to the outer body member 78.

The outer body member 78 as illustrated is generally cylindrical and comprises a bottom wall 82 and a peripheral side wall 84 extending upwardly from the bottom wall 82 to an upper edge 86 defining the open top 72 of the body 70. The upper edge can comprise an annular beaded rim 88. The peripheral side wall 84 can include one or more reinforcing ribs 90. As illustrated, three vertically-spaced, circumferential ribs 90 are formed in the peripheral side wall 84.

The inner body member 80 as illustrated is generally cylindrical and comprises a bottom wall assembly 92 and a first peripheral side wall 94 extending upwardly from the bottom wall assembly 92 and transitioning to a second peripheral side wall 96 defining an open top 98 of the inner body member 80. The second peripheral side wall 96 can comprise an annular flange 100 that can be configured to contact the peripheral side wall 84 of the outer body member 78. The first peripheral side wall 94 includes a shoulder 102 which joins the second peripheral side wall 96, and which is vertically-spaced below the flange 100. The shoulder 102 forms the transition between the first and second peripheral side walls 94, 96, wherein the first peripheral side wall 94 defines a smaller inner diameter of the inner body member 80 that the inner diameter defined by the second peripheral side wall 96.

Figure 5:
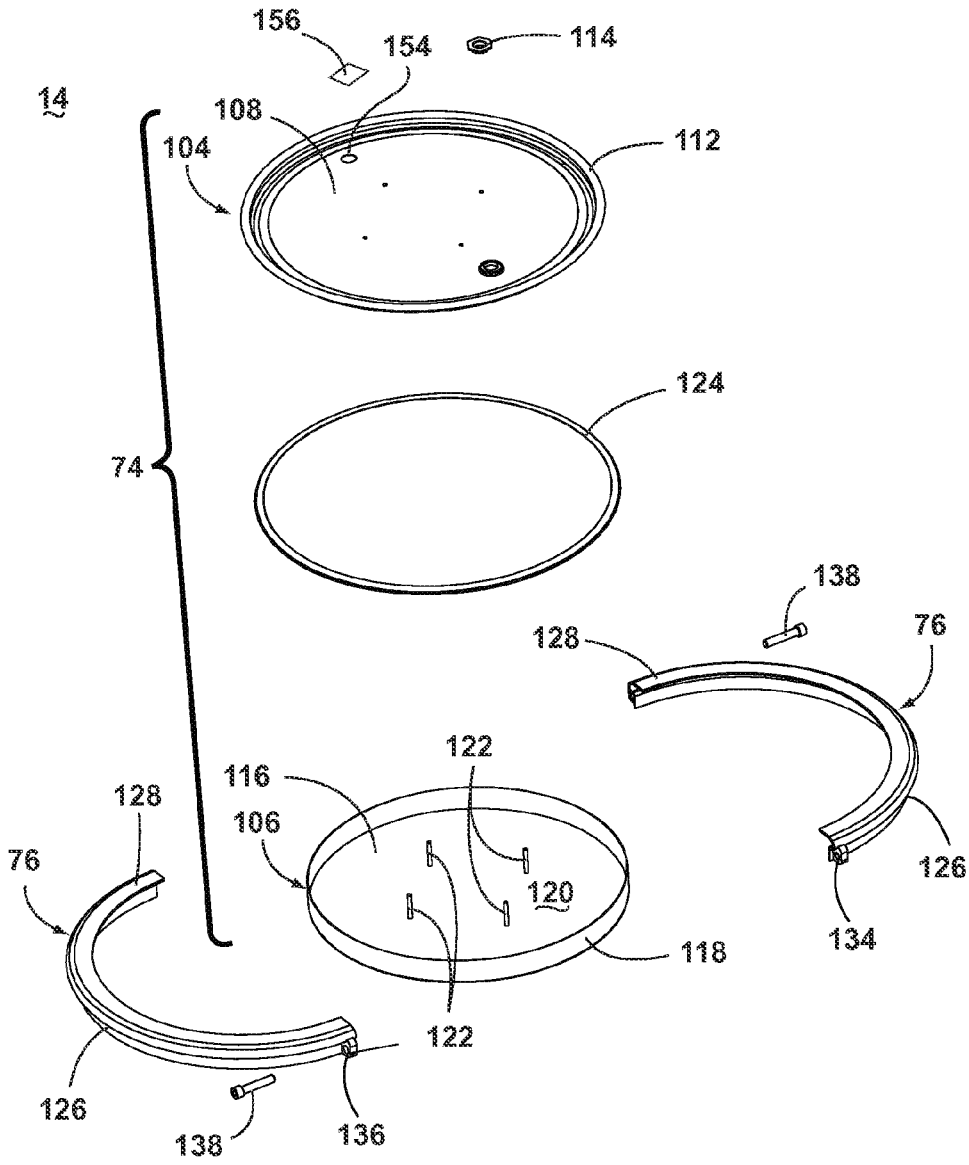
FIG. 5 is an exploded, perspective view of the lid assembly and the split ring assembly of the shipping container from FIG. 4.

Referring additionally to FIG. 5, which is an exploded view of the lid assembly 74 and the split ring assembly 76, the lid assembly 74 includes a lid top 104 and a lid liner 106 attached to the bottom of the lid top 104. The lid top 104 can comprise a circular plate 108 with a peripheral side wall 110 extending upwardly from the plate 108 and having an annular curved flange 112 at the upper end of the side wall 110. The plate 108 can have a slight convex shape. One or more bung hole features 114 can be provided in the plate 108. The lid liner 106 can have a pan-like shape, with a bottom wall 116 and a peripheral side wall 118 that is attached to the underside of the plate 108 to define an interior space 120. The diameter of the lid liner 106 can be slightly less than the diameter of the lid top 104, such that the peripheral side wall 118 of the lid liner 106 is spaced inwardly of the peripheral side wall 110 of the plate 108. The lid liner 106 can be joined with the lid top 104 in any suitable manner. In one embodiment, the lid liner 106 can be welded to the lid top 104. The lid liner 106 can be manufactured by metal spinning. The lid top 104 and lid liner 106 can be manufactured from carbon steel.

One or more reinforcing members can be disposed within the space 120 of the lid assembly 74 to increase the strength of the lid top 104 with respect to the lid liner 106. In FIG. 5, the reinforcing members comprise one or more tie rods 122 provided within the space 120 and extending from the bottom wall 116 of the lid liner 106 to the plate 108 of the lid top 104. As illustrated, four circumferentially-spaced rods are provided, such that the tie rods 122 are placed at approximately 90° intervals about the circumference of the lid assembly 74. The tie rods 122 can be laterally spaced between the peripheral side wall 118 of the lid liner 106 and the longitudinal axis of the lid assembly 74. The tie rods 122 can be joined with the lid top 104 and lid liner 106 in any suitable manner, such as by welding. The tie rods 122 can be oriented along generally vertical planes, and provide added resistance to loads from impacts on any part of the shipping container assembly 10, such as those experienced during crushing or dropping. A gasket 124 can be positioned between the curved flange 112 of the lid top 104 and the upper edge 86 of the outer body member 78. The gasket 124 can be formed of a fire-retardant material.

Other examples of suitable reinforcing members 122 for the lid assembly 74 include any connecting members of any shape, size and/or attachment method that provide structural strength by tying or otherwise connecting the plate 108 of the lid top 104 to the bottom wall 116 of the lid liner 106.

Figure 6:
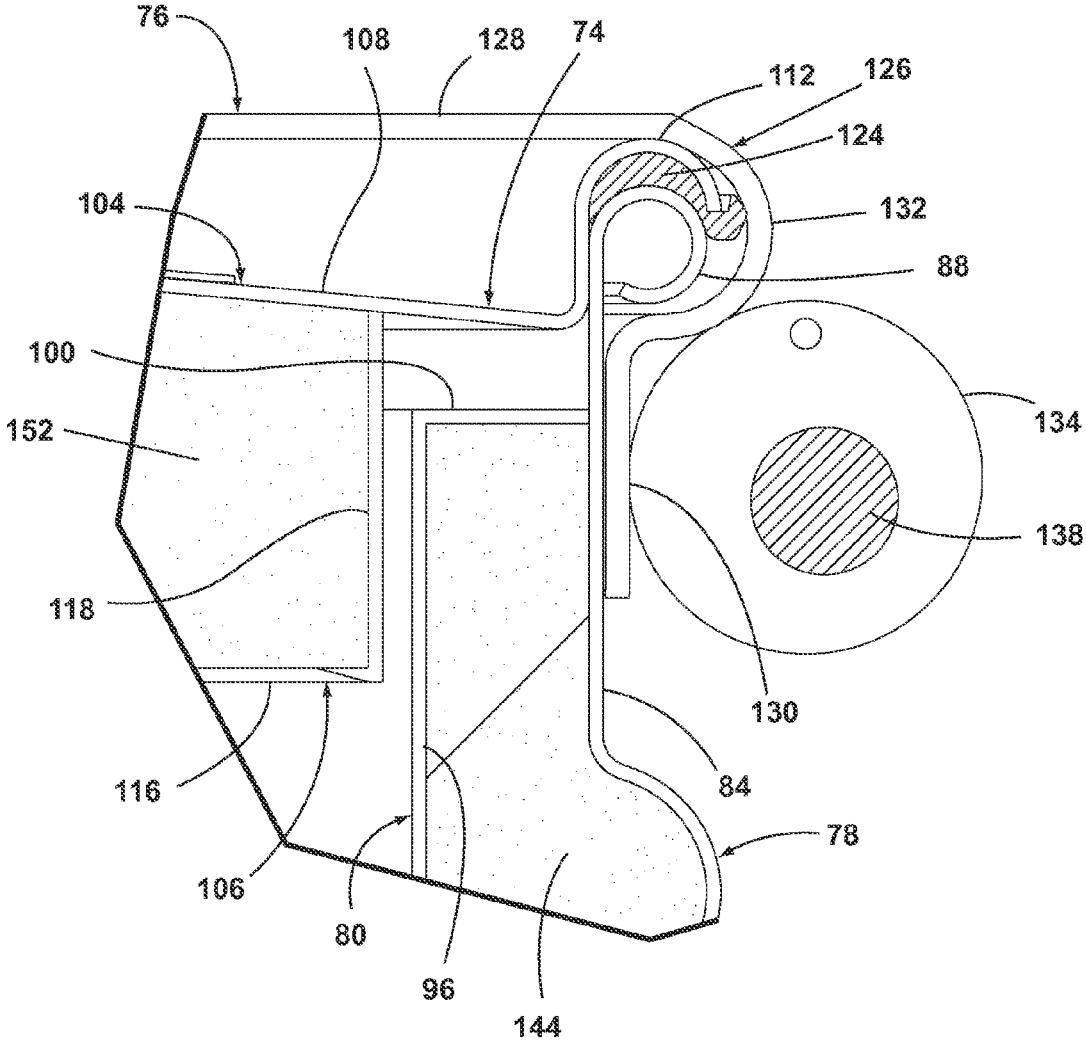
FIG. 6 is a close-up view of section VI of FIG. 1.

Referring additionally to FIG. 6, which is a close-up view of section VI of FIG. 1, the split ring assembly 76 can be similar to the split ring assembly 26 of the material container 12, with adjustments for the difference in size between the material container 12 and the shipping container 14. As illustrated, the split ring assembly 76 can comprise a pair of hemispherical retaining rings 126, each having a an annular top wall 128 joined to a side wall 130 by a curved portion 132 and terminating at one end in a threaded lug 134 and at the other end in an unthreaded lug 136. The retaining rings 126 can be applied about assembled body 70 and lid assembly 74, with the curved portion 132 receiving the beaded rim 88 of the body 70 and the curved flange 112 of the lid assembly 74, the side wall 130 flush or nearly flush against the peripheral side wall 84 of the outer body member 78, and the top wall 128 overlying the lid assembly 74. In this position, the threaded lug 134 on one ring 126 is matched with the unthreaded lug 136 on the other ring 126. At least one fastener 138 secures the each pair of lugs 134, 136 together.

Figure 7:
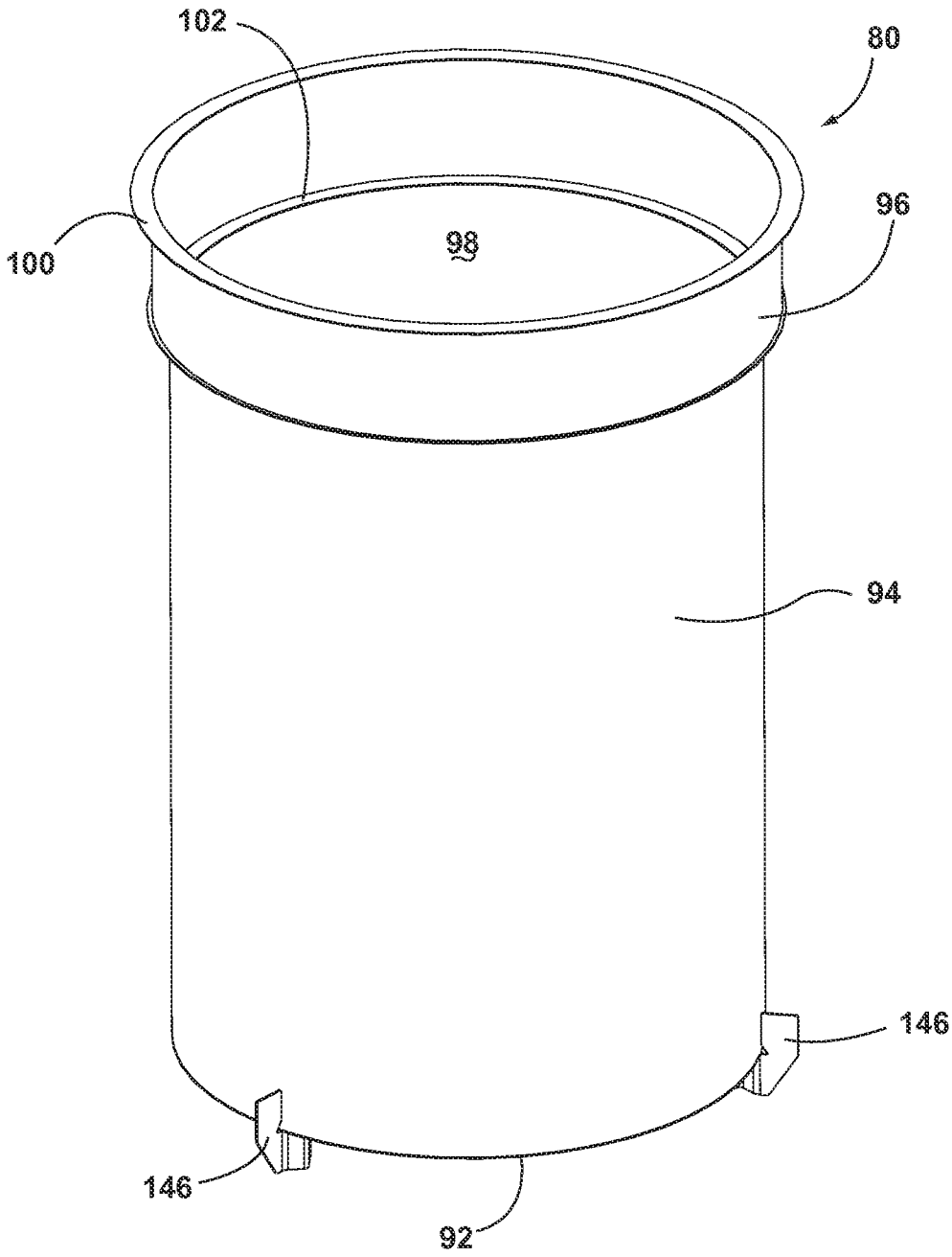
FIG. 7 is a perspective view of an inner body member or liner of the body of the shipping container from FIG. 4.

As shown in FIG. 4, the dimensions of the inner body member 80 are such that the inner body member 80 can be received within the outer body member 78 with a space between their respective bottom walls 82, 92 and peripheral side walls 84, 94, 96. FIG. 7 is a perspective view of the inner body member 80 of the shipping container 14 from FIG. 4. At least one spacer 146 can be provided on the inner body member 80 to maintain the spaced relationship of the outer and inner body members 78, 80 shown in FIG. 4. As illustrated, two spacers 146 are positioned on the inner body member 80, and are generally L-shaped, with one leg of the spacer 146 extending along a lower portion of the first peripheral side wall 94 and another leg of the spacer 146 extending along an outer portion of the bottom wall assembly 92. The spacers 146 help maintain the alignment of the inner body member 80 and the outer body member 78 during assembly, and also provide additional structural reinforcement to the outer shipping container 14. While two spacers 146 are illustrated, it is within the scope of the invention for any number of spacers 146 to be provided. In yet another alternate embodiment, one or more spacers 146 can be provided within the interior of the outer body member 78 rather than on the exterior of the inner body member 80 as illustrated.

Returning to FIG. 4, the space between the outer and inner body members 78, 80 can be filled with a liner material 144 to increase the stiffness of the body 70, such as a structural and/or high impact foam. The foam can additionally be heat-retardant. One example of a suitable structural and heat-retardant foam is polyurethane. The polyurethane foam can be a two-part liquid that is mixed as it is injected, and sets to form a rigid, closed-cell foam. In one embodiment, the liner material 144 may be polyurethane foam sold under the trade name BETAFOAM™ 87100/87124 by Dow.

The outer body member 78 can comprise one or more openings 148 to the space. As illustrated, three vertically-spaced openings 148 can be formed at 120° intervals in the peripheral side wall 84 for a total of nine openings 148, only 3 of which are visible in FIG. 4. The openings 148 can be used to inject or pour the liner material 144 into the space between the outer and inner body members 78, 80. The openings 148 allow visual observation of the filling operation, including when the filling is complete or approaching completion. The openings 148 can also function as ventilation holes, whereby pressure buildup inside the body 70 is prevented. After adding the liner material 144, the openings 148 can optionally be covered. As shown in the present embodiment, the openings 148 can be sealed with plugs 150. The plugs 150 can be manufactured from a transparent material, such as polycarbonate, to permit visual verification that the liner material 144 is completed in accordance with specifications. Alternatively, the openings 148 can be covered with an adhesive covering, such as an adhesive tape. The tape can, for example, be manufactured from aluminum foil.

The space defined between the lid top 104 and lid liner 106 can also be filled with a liner material 152 to increase the stiffness of the lid assembly 74. The liner material 152 can be the same or substantially the same as the liner material 144 of the body 70. The liner material 152 can be introduced into the space through at least one opening 154 (FIG. 5) formed in the lid assembly, and hardens in place around the tie rods 122. As illustrated, one opening 154 is formed in the plate 108 of the lid top 104. After adding the liner material 152, the opening 154 can be covered and/or sealed with tape 156. The tape 156 can be manufactured from aluminum foil. Alternately, the opening 154 can be sealed with a plug similar to the plugs 150 used to seal the openings 148 in the body 70.

Figure 8:
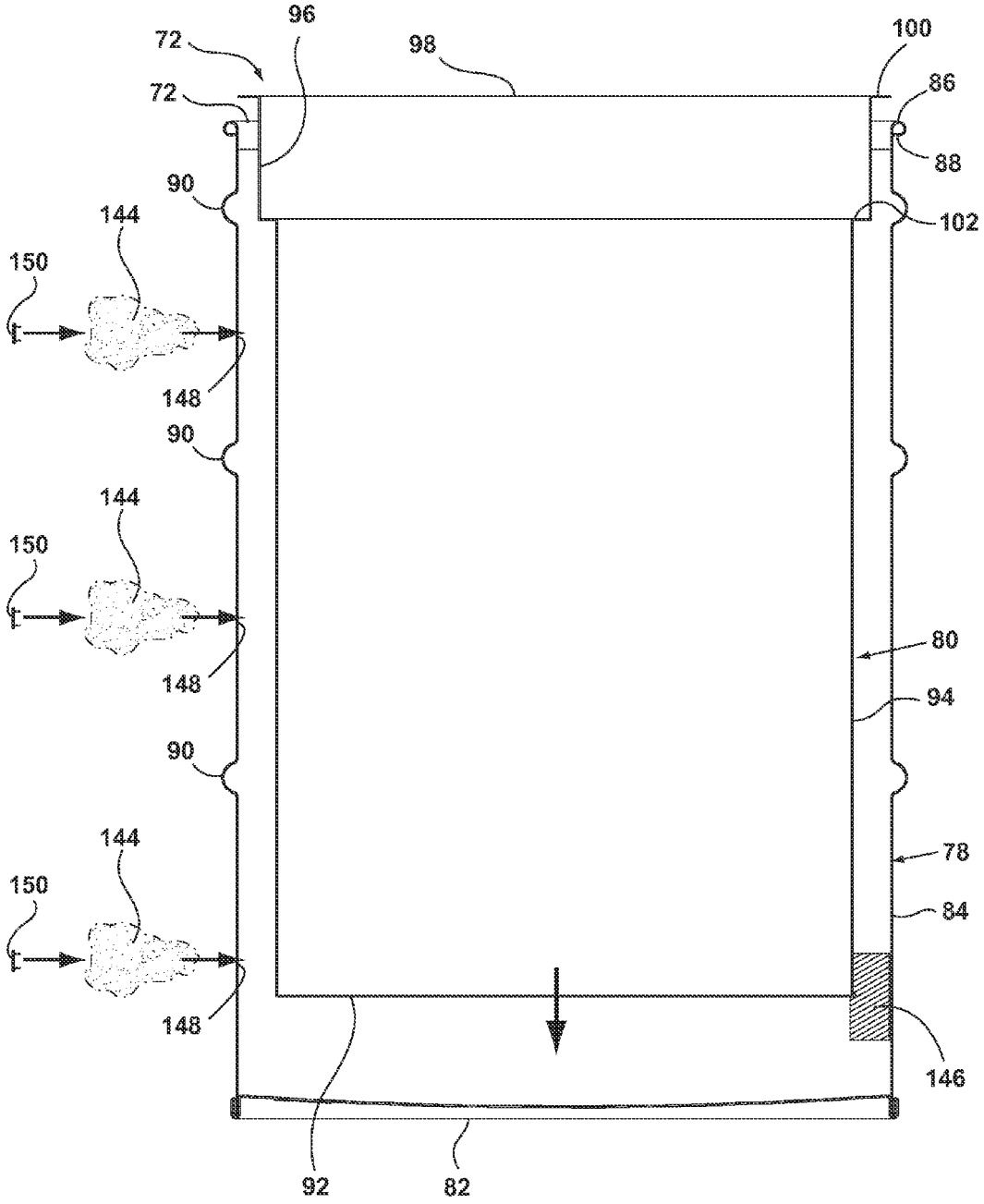
FIG. 8 is a schematic illustration showing the assembly of the body of the shipping container from FIG. 4.

FIG. 8 is a schematic illustration showing the assembly of the body 70 of the shipping container 14 from FIG. 4. To assemble the body 70 of the shipping container 14, the inner body member 80 can be joined with the outer body member 78 in any suitable manner, such as by welding the inner body member 80 in place within the outer body member 78. The spacers 146 ensure that a space is formed between the respective bottom walls 82, 92 and peripheral side walls 84, 94, 96 of the outer and inner body members 78, 80. The liner material 144 can be injected or poured into the space through the openings 148 in the outer body member 78, and can set or harden in place. The openings 148 can thereafter be sealed with plugs 150 or otherwise covered, such as with adhesive tape.

Figure 8A:
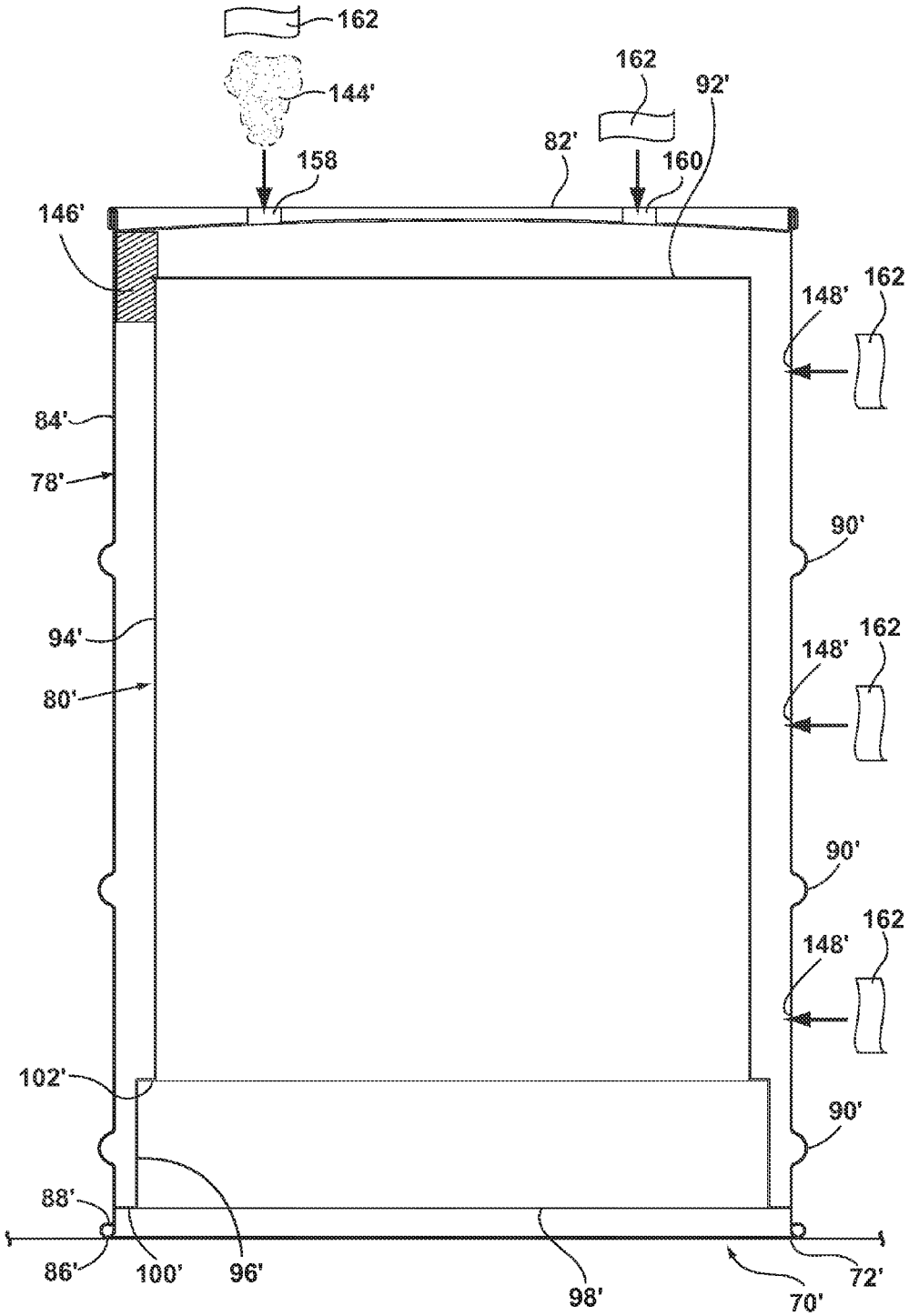
FIG. 8A is a schematic illustration showing the assembly of a body in accordance with another embodiment of the invention which can be used with the shipping container from FIG. 4.

FIG. 8A is a schematic illustration showing the assembly of a body 70' in accordance with another embodiment of the invention, which may be used in place of the body 70 for the shipping container 14 from FIG. 4, and in which like elements are designated by the same reference numeral bearing a prime (') symbol. The body 70' may be substantially similar to the body 70 shown in FIG. 8, with the exception of the features provided in the bottom wall 82' and the side wall 84' of the outer body member 78'. The bottom wall 82' is provided with a fill opening 158 and a ventilation opening 160. Furthermore, the openings 148' in the side wall 84' are not sealed with plugs. To assemble the body 70', the inner body member 80' can be joined with the outer body member 78' in any suitable manner, such as by welding the inner body member 80' in place within the outer body member 78'. The spacers 146' ensure that a space is formed between the respective bottom walls 82', 92' and peripheral side walls 84', 94', 96' of the outer and inner body members 78', 80'. The body 70' is then oriented such that the bottom surface 82' is accessible. For example, the body 70' can be oriented upside-down to its normal use configuration, as shown in FIG. 8*a*, such that the body 70' rests on the upper edge 86' of the outer body member 78' and the bottom surface 82' faces upwardly. The liner material 144' can be injected or poured into the space through the fill opening 158 in the outer body member 78', and can set or harden in place. In this embodiment, liner material 144' is not injected via the openings 148' in the side wall 84'. During filling, the openings 148' and 160 function as ventilation holes, whereby pressure buildup inside the body 70' is prevented. The openings 148' and 160 also allow visual observation of the filling operation, including when the filling is complete or approaching completion. The fill opening 158 and ventilation openings 148', 160 can thereafter be seal and/or covered, such as with adhesive tape 162. Alternatively, the fill opening 158 and ventilation openings 148', 160 can be sealed with a plug similar to plug 150.

Figure 9:
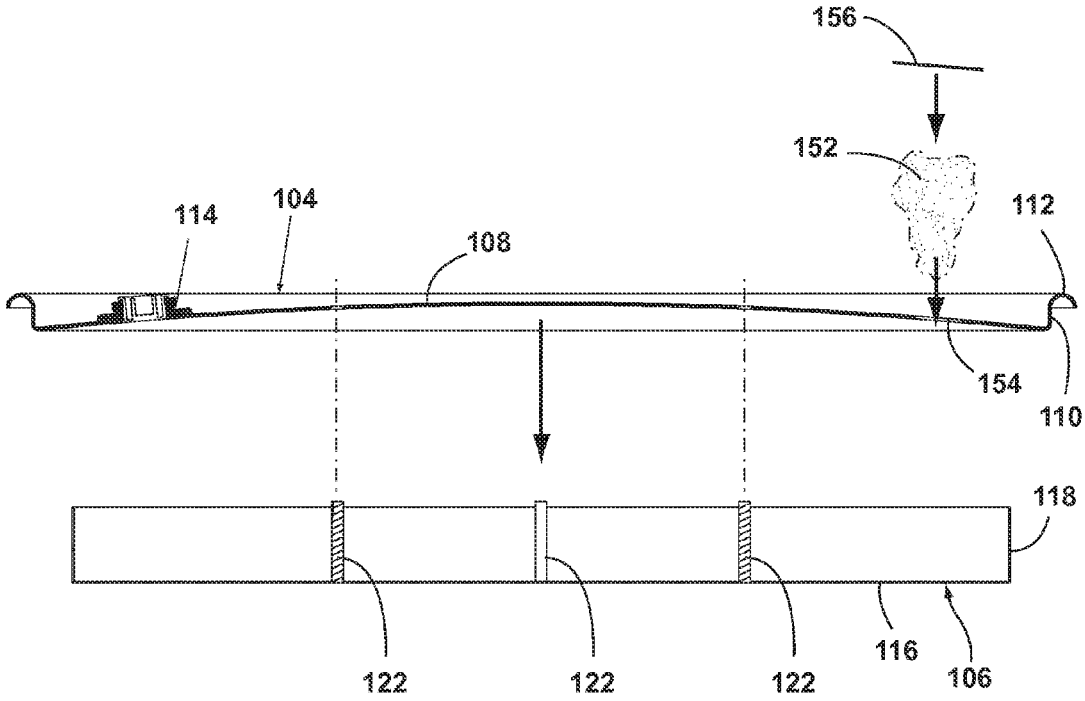
FIG. 9 is a schematic illustration showing the assembly of the lid assembly the shipping container from FIG. 4.

FIG. 9 is a schematic illustration showing the assembly of the lid assembly the shipping container from FIG. 4. To assembly the lid assembly 74 of the shipping container, the lid liner 106 can be joined with the lid top 104 in any suitable manner, such as by welding the lid liner 106 to the underside of the lid top 104 to form an interior space. The tie rods 122 can also be welded to at least one of the lid top 104 and lid liner 106 prior to welding the lid liner 106 to the underside of the lid top 104. The liner material 152 can be injected or poured into the interior space through the opening 154 in the lid top 104, and hardens in place around the tie rods 122. The opening can thereafter be covered and/or sealed with the tape 156.

Non-destructive methods, such as thermal imaging, ultrasonic evaluation, radiography and/or visual observation via the openings, can be used to verify that the spaces in the body 70 and lid assembly 74 are completely filled with liner material 144, 152. The in situ density of the liner material 144, 152 can be determined by weighing the body 70 and lid assembly 74 before and after the filling operation.

Figure 10:
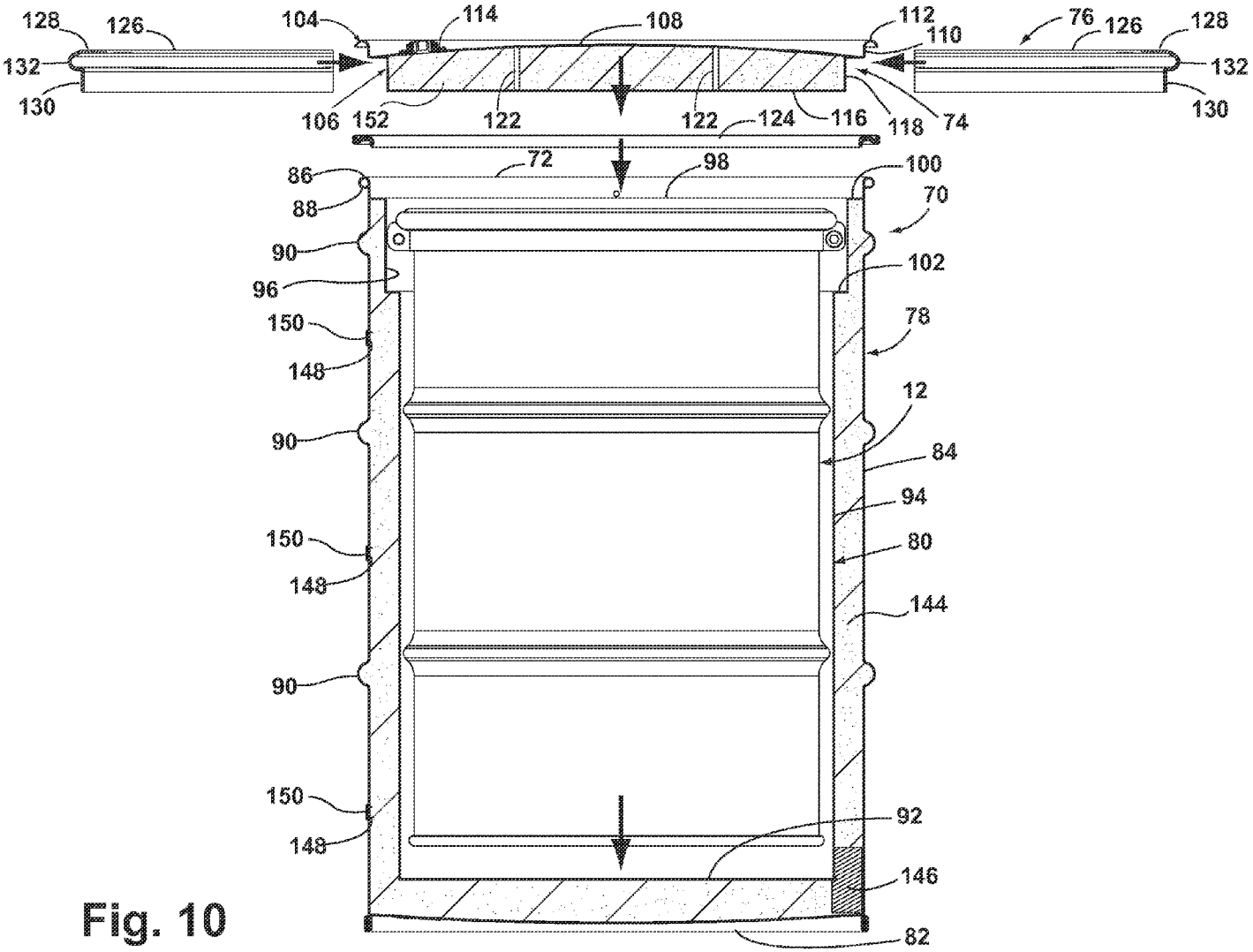
FIG. 10 is a schematic illustration showing the enclosure of the material container within the shipping container from FIG. 1.

FIG. 10 is a schematic illustration showing the enclosure of the material container within the shipping container from FIG. 1. With reference to FIG. 1, in use, the assembled body 70 can receive the inner material container 12. The inner body member 80 is stepped at the shoulder 102 to allow the split ring assembly 26 of the inner material container 12 to clear the second peripheral side wall 96 of the inner body member 80. Once the inner material container 12 is received, the lid assembly 74 can be seated on the body 70, with the gasket 124 captured between the curved flange 112 of the lid top 104 and the flange 100 of the body inner body member 80, to enclose the inner material container 12. The inner body member 80 is also stepped at the upper edge 98 by the annular flange 100 to allow the lid liner 106 of the lid assembly 74 to protrude into the upper portion of the inner body member 80. This lapping feature allows the load from impact, such as those experienced during crushing of the shipping container assembly 10, to be diverted to the outer shipping container 14 rather than delivered to the lid 24 of the inner material container 12. The split ring assembly 76 can then be applied about assembled body 70 and lid assembly 74, as described above with reference to FIG. 6, to secure the lid assembly 76 to the body 70.

The forgoing sequence of steps described with respect to FIGS. 8-10 is for illustrative purposes only and is not meant to limit the assembly of the shipping container 14 or shipping container assembly 10 in any way as it is understood that the steps may proceed in a different logical order, additional or intervening steps may be included, or described steps may be divided into multiple steps, without detracting from the invention.

The shipping of hazardous material is highly regulated in the United States and in other countries; as such, shipping containers must meet certain standards with respect to fire-resistance, water-tightness and structural integrity, including impact-resistance. The foregoing describes an embodiment of a shipping container assembly 10 according to the present invention that has improved structural integrity, including improved impact-resistance. The impact-resistance of the shipping container assembly 10 is enhanced by the design of the outer shipping container 14. The liner material 144, 152 of the body 70 and lid assembly 74 improves the structural integrity of the shipping container assembly 10 by improving the rigidity of the shipping container 14. The tie rods 122 and the liner material 152 of the lid assembly 74 improve the structural integrity of the shipping container assembly by improving the impact-resistance of the shipping container 14. The tie rods 122 can carry tensile loads, while the liner material 152 can carry compressive loads.

The shipping container assembly 10 of the present invention incorporates a unique design, including the integral inner body member 80 or liner within the outer body member 78 that is closed by the reinforced lid assembly 74. The unique design also incorporates the liner material 144, 152 for structural integrity and other features to protect the contents of the shipping container assembly 10 from release during shipping. Basing the design of the shipping container assembly 10 on a standard 55-gallon drum-type vessel for the outer shipping container 14 and a standard 30-gallon drum-type vessel for the inner material container allows operators to use standard drum-handling equipment and devices, and simplifies fabrication. The use of polyurethane foam for the liner material 144, 152 protects the contents of the shipping container assembly 10 thermally and structurally. The polyurethane foam is not affected by moisture, vibration, or temperature within anticipated operating ranges, unlike previously used liner material like fiberboard. The features of the shipping container assembly 10 are smooth, which allows for reliable decontamination and cleaning, and are resistant to damage during normal operations. Of course, while standard-sized shipping containers (e.g., 55- and 30-gallon) are disclosed, it will be understood that other standard sizes, or any sized shipping containers can be used without departing from the scope of this invention.

Government regulations from DOT and NRC for shipping hazardous material have recently changed. As part of these changes, there has developed a need for shipping containers to replace containers to replace existing shipping containers no longer allowed by the government regulations, which include new standards of rigorous testing. Due to the change in government regulations, previous shipping containers do not have the structural integrity needed to meet the new standards of rigorous testing. Other designs have either failed the testing or are cost-prohibitive.

The design of the shipping container assembly 10 according to the present invention leverages the strengths of the different materials used for the components of the shipping container in key alignment to create three-dimensional stability and strength, which permits the shipping container assembly 10 to withstand anticipated forces from any direction. The shipping container assembly 10 is able to meeting the new standards of rigorous testing in accordance with the new government regulations from DOT and NRC, while remaining cost-efficient. As such, the shipping container assembly 10 fills a commercial need that is no longer being met by existing shipping containers.

Certain NRC regulations require that a shipping container retain its contents when subjected to numerous "normal" and "hypothetical accident" conditions, termed Normal Conditions of Transport (NCT) and Hypothetical Accident Conditions (HAC). These imposed condition requirements include, in part, that a shipping container be subjected to drop tests, crush tests involving a 1100-lb plate and 1475° F. fire thermal tests. Features incorporated into the design of the shipping container assembly 10 according to the present invention uniquely address protecting the confined contents confined when being subjected to these "normal" and "hypothetical accident" events. For example, a shipping container assembly 10 according to the present invention was subjected to the crush test, in which a plate weighing approximately 1100 lbs. was dropped from a height of approximately 30 ft. The test was run with the shipping container assembly 10: (1) resting on the peripheral side wall 30 of the outer shipping container 14 (i.e. on its side); and (2) orientated at a 45° angle. In both orientations, the shipping container assembly 10 remained closed after impact with the plate. A shipping container assembly 10 was also subjected to the drop test, and was dropped in a free fall position from a height of approximately 30 ft. The shipping container assembly 10 remained closed after impacting the ground surface.

While the invention has been specifically described in connection with certain specific embodiments thereof, it is to be understood that this is by way of illustration and not of limitation, and the scope of the appended claims should be construed as broadly as the prior art will permit. For example, while the shipping container assembly has been discussed in the context of receiving a material container containing nuclear, radioactive, and/or other hazardous material, the shipping container assembly can be used to ship and/or store other items. Reasonable variation and modification are possible within the forgoing disclosure and drawings without departing from the scope of the invention which is defined by the appended claims. It should also be noted that all elements of all of the claims may be combined with each other in any possible combination, even if the combinations have not been expressly claimed.

What is claimed is:

1. A shipping container for enclosing a material container containing a hazardous material, comprising:

a body having a bottom wall, a side wall extending from the bottom wall to an open top;

a liner disposed within the body in a spaced relationship to an interior surface of the body, the liner having a bottom wall and a side wall extending from the bottom wall and defining a space between the bottom wall and the side wall of the liner and the bottom wall and the side wall of the body;

a foam material disposed in the space between the body and the liner;

a lid assembly for closing the open top, the lid assembly comprising:

a lid top;

a lid liner coupled to the lid top to define a lid space therebetween;

a foam material disposed in the lid space between the lid top and the lid liner; and a plurality of reinforcing members disposed within the lid space to increase the compression strength of the lid top with respect to the lid liner; and a split-ring, assembly which secures the lid assembly to the periphery of the open top of the body;

whereby, when the lid assembly is secured to the body, a storage chamber is defined within the body by the liner and an interior surface of the lid assembly, and the foam material in the lid assembly and in the body at least partially overlap to form a generally continuous periphery around the storage chamber.

2. The shipping container of claim 1 wherein the lid liner extends downwardly from the lid top to form an upper surface of the storage chamber when the lid assembly is mounted to the open top of the body.

3. The shipping container of claim 2 wherein the lid top has a first lid periphery, and the lid liner has second lid periphery that is smaller than the first lid periphery and is sized for receipt by the liner within the open top of the body.

4. The shipping container of claim 2 wherein a portion of the foam material within the lid space depends from the lid top a sufficient extent to be in vertical register with a portion of the foam material located within an upper portion of the space between the body and the liner when the lid assembly is mounted over the open top of the body.

5. The shipping container of claim 1 wherein an inner wall of the liner further comprises a liner shoulder extending radially inwardly therefrom adjacent an upper portion of the inner wall.

6. The shipping container of claim 5 wherein the material container comprises a container shoulder extending radially outwardly from an outer sidewall thereof and, when the material container is placed within the storage chamber, the container shoulder is in register with the liner shoulder.

7. The shipping container of claim 1 wherein an inner wall of the liner further comprises a flange extending radially outwardly from an upper portion of the inner wall to the body, wherein a portion of the lid assembly extends below the flange when the lid assembly is mounted over the open top of the body.

8. The shipping container of claim 1 wherein the liner is formed from a metal material.

9. The shipping container of claim 8 wherein the liner is formed of steel.

10. The shipping container of claim 1 wherein the foam material comprises a rigid, closed-cell foam.

11. The shipping container of claim 10 wherein the foam material comprises polyurethane.

12. The shipping container of claim 1 wherein at least one of the liner and the body comprises at least one spacer mounted to the at least one of the liner and the body.

13. The shipping container of claim 12 wherein the at least one spacer comprises a plurality of legs mounted to a lower portion of the liner.

14. The shipping container of claim 1 wherein the material container has a volume of 30 gallons and the body has a volume of approximately 55 gallons.

15. The shipping container of claim 1, and further comprising an insulation bag within the body.

16. The shipping container of claim 1, wherein the plurality of reinforcing members comprise a plurality of tie rods extending from the lid liner to the lid top within the lid space.

17. The shipping container of claim 16 wherein the tie rods are embedded within the foam material disposed in the lid space.

18. The shipping container of claim 1 wherein the foam material disposed in the lid space fills substantially the entire lid space, such that the plurality of reinforcing members is embedded within the foam material.

* * * * *